United States Patent [19]

Willey et al.

[11] Patent Number: 5,008,680

[45] Date of Patent: Apr. 16, 1991

[54] PROGRAMMABLE BEAM TRANSFORM AND BEAM STEERING CONTROL SYSTEM FOR A PHASED ARRAY RADAR ANTENNA

[75] Inventors: Jefferson M. Willey, Columbia, Md.; James J. Alter, Fairfax Station; Jules P. Letellier, Springfield, both of Va.

[73] Assignee: The United States of America as represented by the Secretary of the Navy, Washington, D.C.

[21] Appl. No.: 187,804

[22] Filed: Apr. 29, 1988

[51] Int. Cl.[5] ..... H01Q 3/22; H01Q 3/24; H01Q 3/26

[52] U.S. Cl. ..... 342/372

[58] Field of Search ..... 342/372

[56] References Cited

U.S. PATENT DOCUMENTS 3,877,012 4/1973 Nelson .
4,178,581 12/1979 Willey, Sr. .
4,445,119 4/1984 Works ..... 342/372

OTHER PUBLICATIONS

Publication, Distributed Beamsteering Control of Phased Array Radars, by T. P. Waldron et al., Microwave Journal, pp. 133–134, 136, 140, 142–144, 146, Sep. 1986.

Publication (limited distribution), An Architecture to Beam Steer and Monitor a Phased Array Radar Antenna, by J. M. Willey, NRL Report 8965, Navel Research Laboratory, Washington, D.C. 20375-5000, 17 total pages, Jun. 12, 1986.

*Primary Examiner*—Theodore M. Blum
*Attorney, Agent, or Firm*—Thomas E. McDonnell; George Jameson

[57] ABSTRACT

A programmable beam transform system is disclosed for performing both beam steering and beam shaping operations in a phased array antenna. A programmable beam transform control circuit is responsive to a plurality of input signals for selectively generating and applying a plurality of control signals to each intelligent phase shift control circuit in an array of phase shift control circuits/phase shifters/antenna elements. Each phase shift control circuit simultaneously modifies the plurality of control signals applied thereto as a function of its internally-stored data to develop its own phase shift command signal which is used by its associated phase shifter to phase shift that portion of the total energy applied thereto. On transmit, the phase-shifted energy outputs from the phase shifters in the array are then respectively transmitted by the associated antenna elements in the array to form the desired beam pattern at the desired beam position; and on receive the complementary function occurs.

18 Claims, 8 Drawing Sheets

PROGRAMMABLE BEAM TRANSFORM AND BEAM STEERING CONTROL SYSTEM FOR A PHASED ARRAY RADAR ANTENNA

BACKGROUND OF THE INVENTION

The present invention relates to electronically steered phased array antennas and particularly to a control system for a phased array antenna that electronically performs both beam steering and beam-shaping operations.

Electronically scanned phased array antennas require a high throughput control system capable of steering the planar wavefront. Three general types of control systems for performing beam steering operations on phased array antennas have been described by T.P. Waldron, S.K. Chin and R.J. Naster in their article, *Distributed Beamsteering Control of Phased Array Radars*, Microwave Journal, pp. 133–146, Sept. 1986.

The first type is a centralized array control system in which a central beam steering computer generates a serial stream of phase commands for each of N rows or columns. The second type involves the central generation of M row and N column phases, which are added at each element in the array. The third type is an element level control computed from broadcast phase gradients by a microprocessor or by a custom controller. This third type of beam steering control system is recognized as providing: maximum steering throughput, reduced bus bandwidth requirements, and simplified error compensation at the element level.

However, all of these prior art general types of beam steering control systems have two disadvantages. Each of them is relatively slow in electronic steering throughput because none of them fully exploits the parallelism of the phase shift computation at the element level. In addition, none of these three types possesses the capability of forming any arbitrary beam shape as a function of phase at the sample points on the phased array.

OBJECTS OF THE INVENTION

Accordingly, it is an object of the invention to provide a control system for a phased array antenna that electronically performs both beam steering and beam shaping operations.

Another object of the invention is to provide a control system for a phased array antenna that has the capability of forming any arbitrary beam shape as a function of phase at the sample points on the phased array.

Another object of the invention is to provide a control system which fully exploits the parallelism of the phase shift computation at the element level of the phased array antenna.

Another object of the invention is to provide a control system for a phased array antenna which optically communicates the parameters of the phase shift algorithm to each phase shifter in the array.

Another object of the invention is to provide a control system for a phased array antenna which communicates the parameters of the phase shift algorithm to each phase shifter in the array by way of one or more buses.

A further object of the invention is to provide a programmable beam transform and beam steering control system for a phased array antenna.

SUMMARY OF THE INVENTION

These and other objects of this invention are achieved by providing a programmable beam transform and beam steering control system for a phased array antenna. A controller selectively applies a plurality of control signals to each phase shift assembly in an array of phase shift assemblies. Each phase shift assembly simultaneously modifies the plurality of control signals as a function of its internally stored data to develop its own phase shift of its associated input energy which is applied thereto from a power distribution network. The assemblies collectively radiate and/or receive the phase-shifted energy in a beam at a desired pointing direction and with a desired pattern.

BRIEF DESCRIPTION OF THE DRAWINGS

These and other objects, features and advantages of the invention, as well as the invention itself, will become better understood by reference to the following detailed description when considered in connection with the accompanying drawings wherein like reference numerals designate identical or corresponding parts throughout the several views, and wherein.

DETAILED DESCRIPTION OF THE PREFERRED EMBODIMENTS

The invention is directed to a programmable control system for a phased array antenna that electronically performs both beam steering and beam shaping operations on an energy beam transmitted from a multi-element or multi-assembly antenna. The wavefront of the transmitted beam can be programmed to have a planar wavefront, for example, search radar applications or a non-planar wavefront which focuses on a given spot in space at a selected azimuth and elevation, or a non-planar, non-symmetric wavefront for other applications. The rest of the embodiments are discussed in terms of RF electromagnetic radiation, but it should be understood that the embodiments are not limited to the RF domain. Thus, the system of the invention enables an operator to programmably change the antenna characteristics at will to selectively obtain such functions as: adaptively collimating the beam to reduce beamwidth while tolerating increased sidelobe levels; providing phase only nulling of nuisance sources in the far field; and endowing electromagnetic counter measures (ECM) abilities to the phased array radar by use of phase functions that change the characteristics of the antenna for ranges of azimuth and/or elevation.

Figure 1:
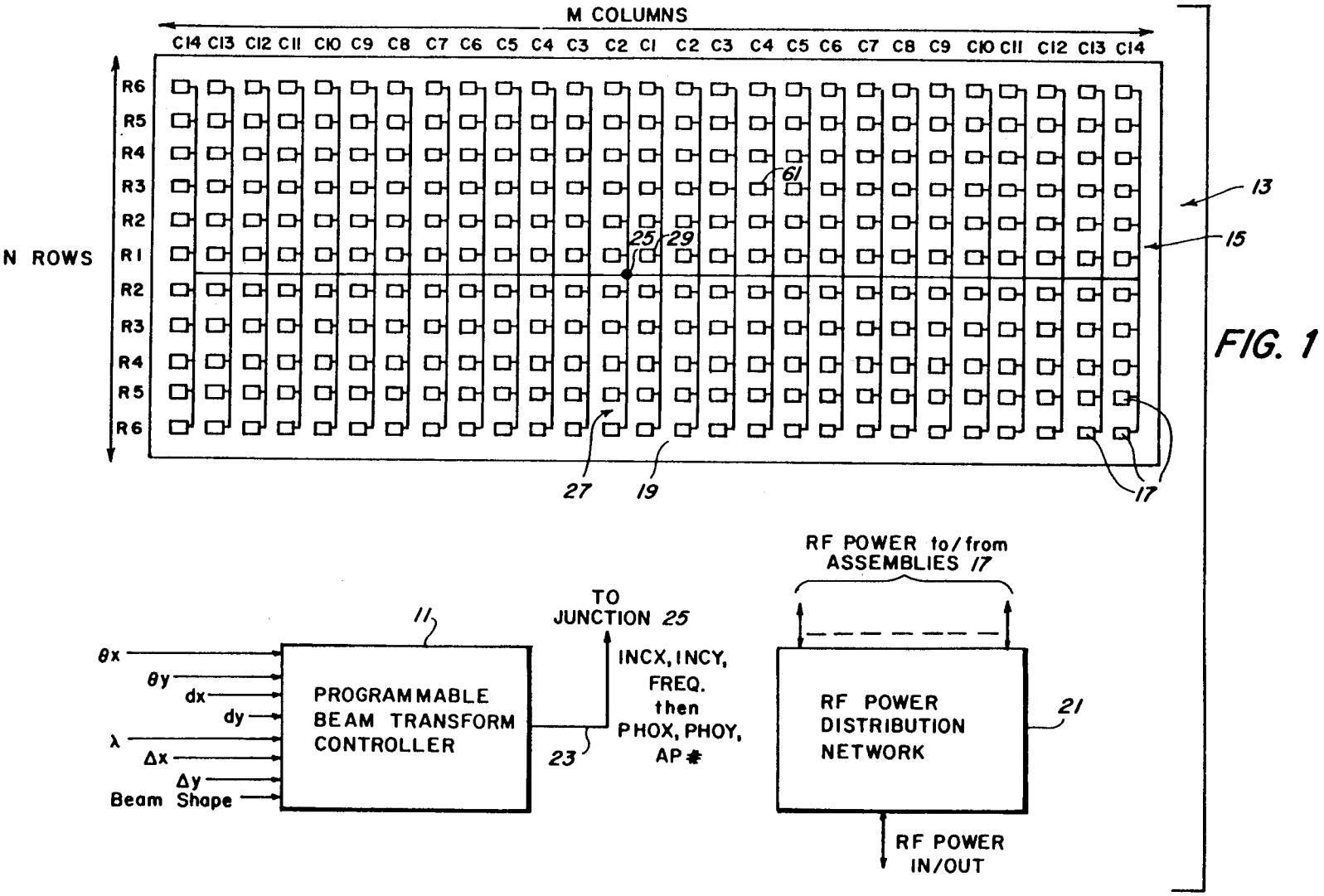
FIG. 1 is a schematic block diagram of a first embodiment of the invention.

Referring now to FIG. 1, a schematic block diagram of a first embodiment of the invention is shown. Basically, the invention includes a programmable beam transform controller 11, and a phased array antenna 13 which includes an array or matrix 15 of M columns and N rows of phase shift assemblies 17. The array 15 is shown facing forward (toward the reader). An antenna backplane 19 is shown disposed behind the array 15. A radio frequency (RF) power distribution network 21 can also be included.

The power distribution network 21 is preferably mounted on the phased array antenna 13 behind the backplane 19 to minimize power loss on transmission. On the other hand, the controller 11 is located at a preselected distance from the array 15.

On transmit the power distribution network 21 distributes portions of input RF power or energy from a transmitter (not shown) to the assemblies 17 in the array 15. The amplitudes of the RF portions respectively distributed to the assemblies 17 are dependent upon the desired illumination taper of the beam to be transmitted by the array 15.

On receive, with the transmitter turned off, the RF power distribution network 21 sums the signals received through the assemblies 17 of the array 15. Thus, the same beam shape applies on both transmit and receive if no phase change was made.

The structure and operation of the power distribution network 21 are well known in the art and, hence, require no further discussion.

The controller 11 is responsive to a plurality of input digital signals ($\theta$x, $\theta$y, dx, dy, $\lambda$, $\Delta$x, $\Delta$y and beam shape) for generating and applying a plurality of digital control signals (INCX, INCY, FREQ, PHOX, PHOY and AP#) to each of the assemblies 17 in the array 15 by means of a composite bus 23 coupled, by way of a junction 25, to a control signal distribution network 27 of the antenna 13. As will be explained later, each assembly 17 modifies the applied plurality of control signals as a function of its own internally-stored data to develop a corresponding phase shift of the RF energy applied thereto. As a result, the assemblies 17 in the array 15 collectively cause a beam to be transmitted and/or received from the antenna array 15 at a desired beam pointing direction or position and with a desired beam pattern.

Figure 2:
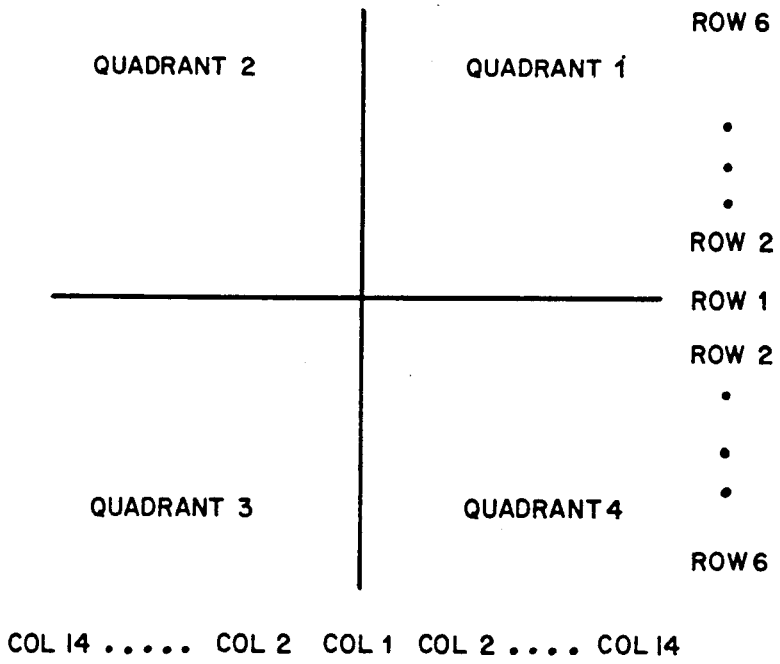
FIG. 2 illustrates the column, row and quadrant locations of each of the phase shift assemblies in the array of FIG. 1.

The assemblies 17 of the array 15 can be mapped into a Cartesian coordinate system and be assigned electrical addresses, such that the center row R1 of assemblies 17 falls onto the abscissa axis and the center column C1 of the assemblies 17 falls on the ordinate axis. For purposes of this discussion assume that M=27 and N=11. In this case, let the electrical addresses for the rows in the antenna backplane 19 start at R1 on the abscissa and increase from R1 through R6 in both elevation directions. Similarly, let the electrical addresses for the columns in the antenna backplane 19 start at C1 on the ordinate axis and increase from C1 through C14 in both azimuth directions. Thus, the physical center of the array 15 is located at the electrical address R1, C1 of center assembly 29. This description does not preclude alternate mappings of the addresses of the assemblies 17. In this implementation the location of each assembly 17 in the array 15 of FIG. 1 is not only determined by the row (R) and column (C) numbers that assembly 17 is in (as discussed above) but also by which one of quadrants 1–4 that assembly 17 is in, as indicated in FIG. 2.

Figure 3:
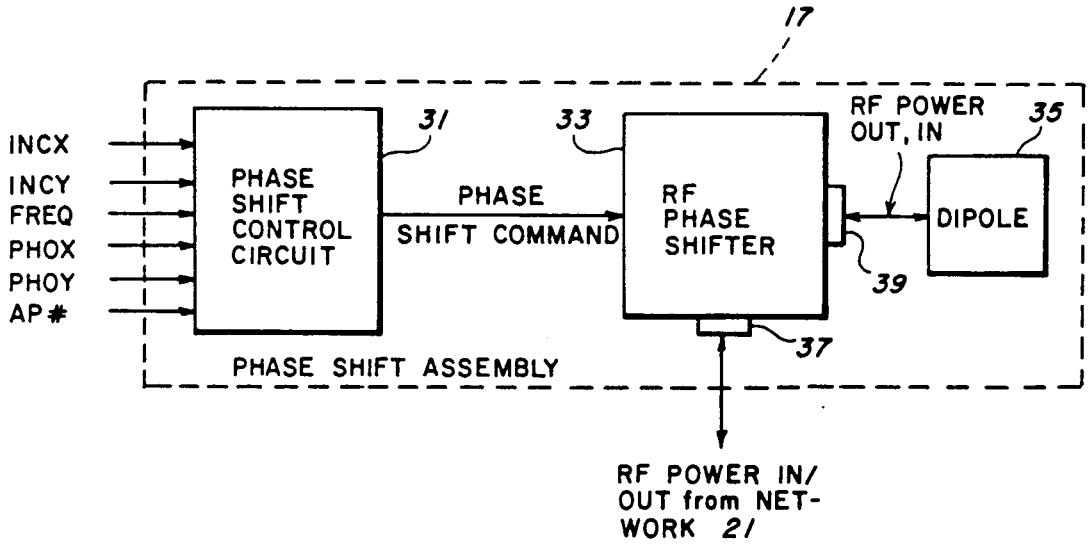
FIG. 3 is a schematic block diagram of one of the phase shift assemblies of FIG. 1.

Referring now to FIG. 3, a schematic block diagram of one of the phase shift assemblies 17 is shown. The phase shift assembly of FIG. 3 includes a phase shift control circuit 31, an RF digital phase shifter 33 and a dipole 35.

The phase shift control circuit 31 modifies the plurality of control signals (INCX, INCY, FREQ, PHOX, PHOY and AP#) from the controller 11 as a function of its own internally stored data (to be explained) in order to develop a digital phase shift command signal.

In this implementation, the phase shifter 33 changes the path length (and therefore the phase) between its input/output and output/input RF ports 37 and 39 as a function of the amplitude of the digital phase shift command signal from the control circuit 31. As a result, the digital phase shift command signal controls the amount of phase shift that the phase shifter 33 imparts to the associated portion of RF power that is conveyed between the input/output port 37 of the phase shifter 33 and the output/input port 39. On transmission the dipole 35 emits the phase-shifted portion of RF energy from the output port 39; and on receive the dipole 35 collects the RF energy and applies it to input port 39.

Since each phase shift control circuit 31 in the array 15 (FIG. 1) can produce its own phase shift command signal as a function of the input plurality of control signals and the modification of those control signals by its own internally stored data, it should be realized that any desired beam pattern at a desired beam pointing direction can be collectively formed by the assemblies 17 in the array 15.

Digital phase shifters, such as the RF phase shifter 33, are well known in the art. For a particular application in a particular electronic equipment, an RF phase shifter would typically be designed and implemented for a desired frequency range and for a desired number of incremental phase shift steps. Whether an RF phase shifter is made-to-order or is an off-the-shelf item, digital phase shifters are controllable by binary logic and essentially operate in the same manner. Various model numbers of switched line digital phase shifters, having different electrical performances, are shown on page 51 of the 1984 catalog of Triange Microwave, Inc., 60 Okner Parkway, Livingston, NJ 07039.

Referring back to FIG. 1, in operation a set of programmable input signals, $\theta$x, $\theta$y, dx, dy, $\lambda$, $\Delta$x, $\Delta$y and beam shape, is applied to the controller 11. These input signals essentially represent: a desired pointing direction in azimuth and elevation of the beam, the dimensions of the antenna 13 in azimuth and elevation, the operating wavelength of the beam, and a desired beam pattern to be formed. More particularly, the $\theta$x and $\theta$y signals respectively represent the angles a desired beam makes with respect to the normal to the array 15 in azimuth and elevation, respectively; the dx and dy signals respectively represent the spacing distance (in meters) between adjacent phase shifters 33 (FIG. 3) in the array 15 in azimuth and elevation, respectively; the $\Delta$x and $\Delta$y signals respectively represent the distances that the phase center of the desired beam is to be displaced from the physical center (R1, C1) of the array 15 in azimuth and elevation, respectively; the $\lambda$signal represents the wavelength of the transmitted beam; and the beam shape signal represents the desired beam pattern.

By changing the beam shape signal over a given range, the shape of the beam pattern can be changed, for example, from a plane wave shape to a parabolic aperture shape by moving the focal point of the array so that it is close in. Such a parabolic aperture shape could be used in an electronic counter measures application to concentrate a large amount of power in a small volume of space, or in a long range search radar application to increase the signal-to-noise ratio of radar signal echoes from very small or distant targets in space. For relatively distant targets, the focal point would be moved out to infinity to produce a plane wave beam. Other shapes are equally feasible.

In response to the programmable input signals ($\theta$x, $\theta$y, dx, dy, $\lambda$, $\Delta$x, $\Delta$y and beam shape) the controller 11 selectively generates and applies a set of parameters or control signals, INCX, INCY, FREQ, PHOX, PHOY and AP#, to each of the phase shift control circuits 31 in the array 15. There are many different ways that these control signals could be applied to the phase shift control circuits 31 (FIG. 3) in the array 15.

In the embodiment of FIG. 1, the INCX, INCY and FREQ control signals are simultaneously generated during a first time period from the controller 11 onto three parallel buses (not shown), represented by the composite bus 23. The composite bus 23 is connected to the junction 25 in the signal distribution network 27 in order to simultaneously feed those three control signals to each of the phase shift control circuits 31 (FIG. 2) in the array 15. During a second time period, the PHOX, PHOY and AP# control signals are generated from the controller 11 over the composite bus 23 to the junction 25 for simultaneous distribution of the PHOX, PHOY and AP# control signals to the phase shift control circuit 31 (FIG. 3) in the array 15. Such a two-time-period operation will be discussed more fully in relation to FIG. 7.

If a shorter processing time is required, the controller 11 could simultaneously output all six control signals (INCX, INCY, FREQ, PHOX, PHOY and AP#) over six parallel buses (not shown, but again represented by composite bus 23) to the junction 25 and network 27 to enable the assemblies 17 to perform their beam transformation, or beam steering and beam shaping, operations during a single time period. Such a one-time-period operation will be discussed more fully in relation to FIG. 8.

Finally, the six control signals from the controller 11 could be serially applied, bit-by-bit, over a single line (not shown) to the junction 25 and network 27 for serial distribution to all of the assemblies 17 in the array 15. In a cableless version of this, the six control signals from the controller 11 are serially transmitted bit-by-bit over the air to each of the assemblies 17, as will be discussed in relation to the second embodiment of FIG. 9.

The assemblies 17 respectively phase shift the associated portions of RF power applied thereto as a function of the six control signals (INCX, INCY, FREQ, PHOX, PHOY and AP#) and their respective internally-stored data (to be discussed). As a result of such individual phase shifting of associated portions of the RF power, the assemblies 17 collectively form an energy beam at a desired pointing direction or position and with a desired beam pattern.

The six control signals generated by the controller 11 can be defined as follows:

INCX = a digital signal representative of the desired phase gradient (or slope) of the beam in the azimuth direction. INCX is the azimuth phase increment between adjacent columns of phase shifters 33 in the array 15.

INCY = a digital signal representative of the desired phase gradient (or slope) of the transmitted beam in the elevation direction. INCY is the elevation phase increment between adjacent rows of phase shifters 33 in the array 15.

FREQ = a digital signal representative of the desired frequency band or range of the energy beam.

PHOX = a digital signal representative of the desired phase offset for the azimuth phase gradient.

PHOY = a digital signal representative of the desired phase offset for the elevation phase gradient.

AP# = a digital signal representative of the desired aperture for the beam pattern.

As stated before, the controller 11 determines the selection of the azimuth and elevation linear phase gradients (INCX and INCY) and their respective phase offsets (PHOX and PHOY) for the planar array 15 as well as the frequency range (FREQ) and aperture (AP#) signals. Each phase shift control circuit 31 (FIG. 3) in the array 15 uses these six control signals, as well as the data that is internally-stored in that circuit 31, in a phase shift algorithm to determine the amount of phase shift that will be imparted to its associated input portion of RF power. This phase shift algorithm is implemented in hardware (to be explained) in each of the assemblies 17.

For ease in understanding the $\theta$x, $\theta$y, dx, dy, INCX, INCY, PHOX and PHOY terms, assume that the controller 11 is programmed by the input signals thereto to develop control signals that will force the assemblies 17 to collectively form a planar wavefront beam from the array 15. The phase shift algorithm in each phase shift control circuit 31 exploits the symmetry of the planar wavefront of the beam formed from the array 15. This planar wavefront may be described by two linear phase gradients in orthogonal directions, as shown in FIGS. 4 and 5.

Figure 4:
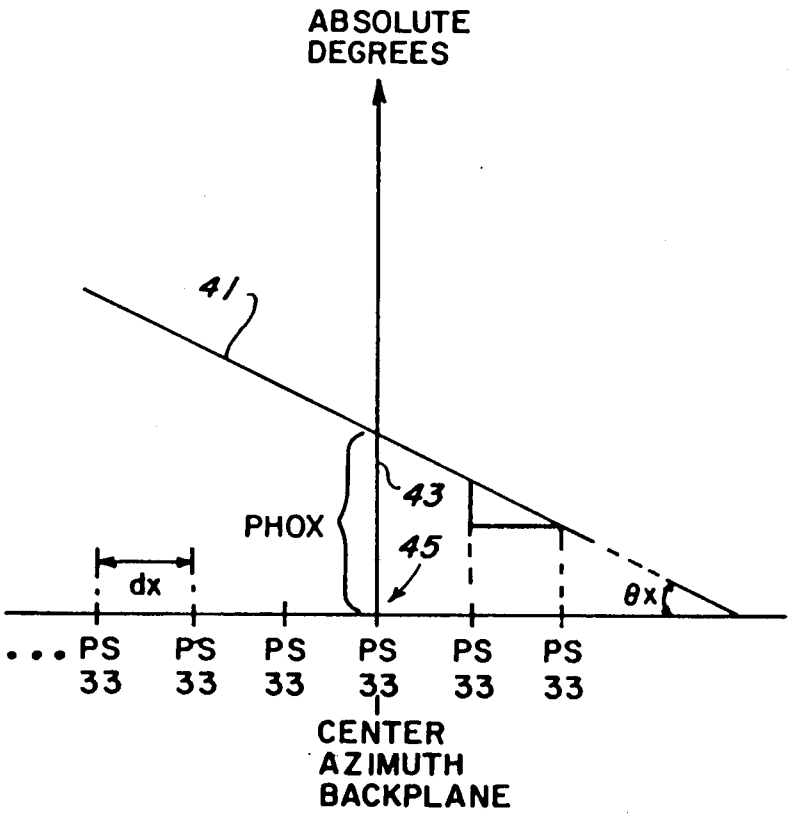
FIG. 4 illustrates an exemplary linear phase gradient of a planar wavefront in an azimuth direction.

FIG. 4 illustrates the azimuth linear phase gradient INCX and its phase offset PHOX. For purposes of simplicity only one line of phase shifters (PS) 33 is shown along the azimuth direction. As will be explained later, the phase shifters 33 are respectively included in an associated line of assemblies 17 (FIG. 1). Line 41 represents the azimuth linear phase gradient INCX, while line 43 represents the azimuth linear phase gradient offset PHOX. The angle between the azimuth phase gradient line 41 and the azimuth backplane line 45 of the array is $\theta$x. The distance between adjacent phase shifters 33 along the azimuth backplane line 45 is dx.

Figure 5:
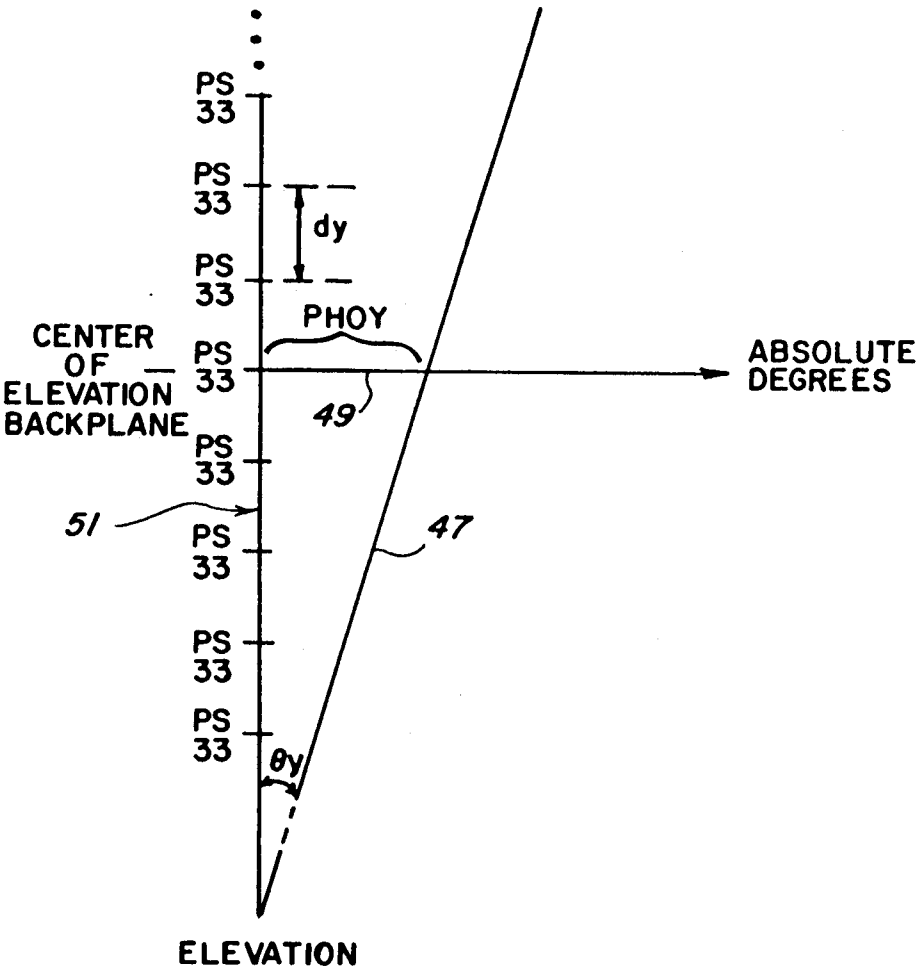
FIG. 5 illustrates an exemplary linear phase gradient of a planar wavefront in an elevation direction.

In a similar manner, FIG. 5 illustrates the elevation linear phase gradient INCY and its phase offset PHOY. Only one line of phase shifters (PS) 33 is shown along the elevation direction. The elevation linear phase gradient INCY is represented by line 47, and the elevation linear phase gradient offset PHOY is shown by a line 49 between line 47 and the elevation backplane 51. The angle between the elevation phase gradient line 47 and the elevation backplane line 51 is $\theta$y. The distance between adjacent phase shifters 33 along the elevation backplane 51 is dy.

Figure 6:
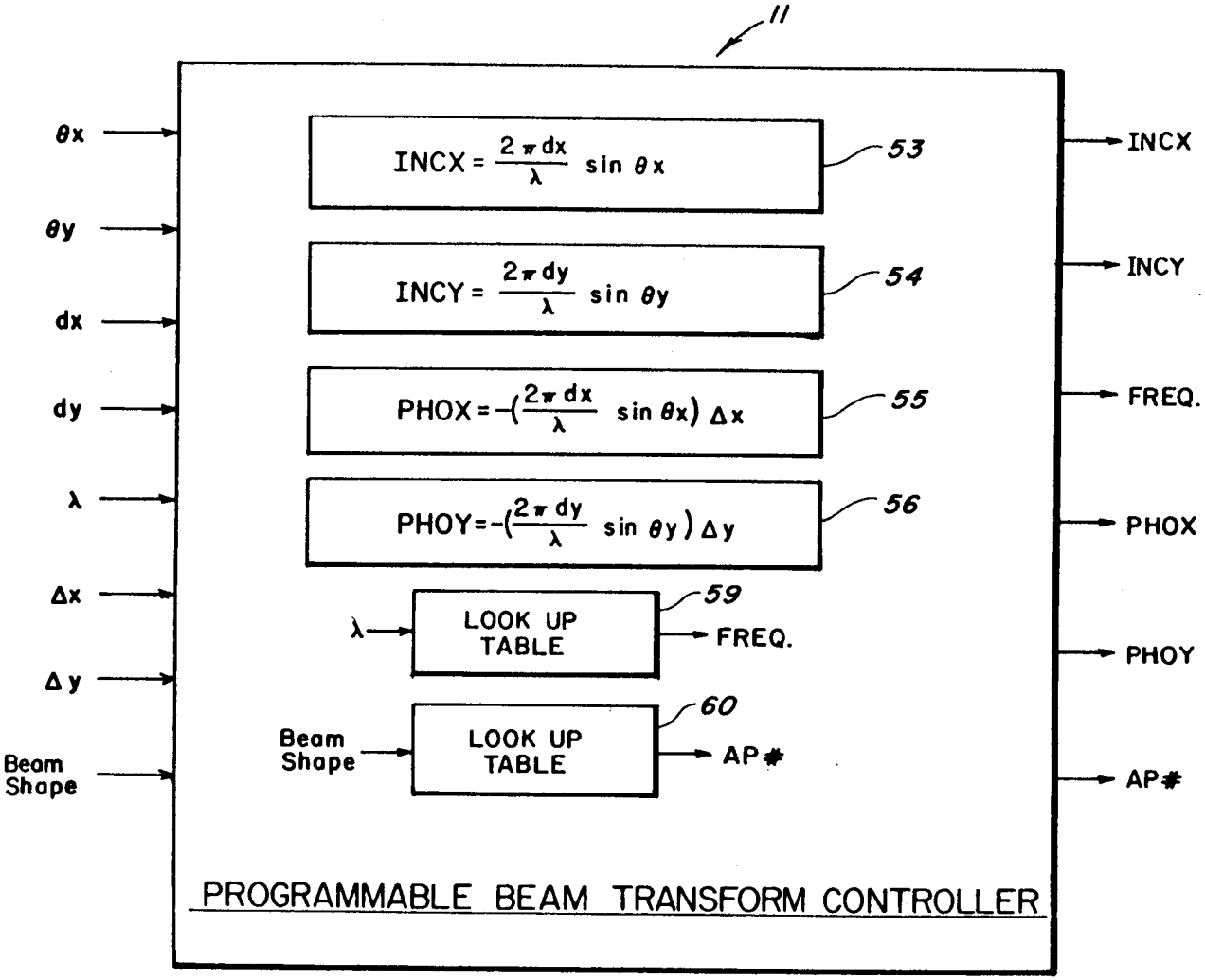
FIG. 6 is a block diagram of the programmable beam transform controller of FIG. 1.

Referring now to FIG. 6, a block diagram of the programmable beam transform controller 11 of FIG. 1 is shown. The values of the programmable input signals ($\theta$x, $\theta$y, dx, dy, $\lambda$, $\Delta$x, $\Delta$y and beam shape) are individually selectable to enable the controller 11 to derive the desired values of the output control signals (INCX, INCY, FREQ, PHOX, PHOY and AP#). In this implementation, controller 11 comprises multiply accumulators (MAC) and arithmetic logic units (ALU) 53 through 56 and look-up tables 59 and 60.

MAC/ALU 53 is implemented to be responsive to input signals $\theta x$, dx and $\lambda$ for computing the value of INCX according to the equation:

$$INCX = (2\pi dx \sin \theta x)/\lambda$$

Similarly, MAC/ALU 54 is implemented to be responsive to input signals $\theta y$, dy and $\alpha$ for computing the value of INCY according to the equation:

$$INCY = (2\pi dy \sin \theta y)/\lambda$$

MAC/ALU 55 is implemented to be responsive to input signals $\theta x$, dx, $\lambda$ and $\Delta x$ for computing the value of PHOX according to the equation:

$$PHOX = -(2\pi dx \sin \theta)\Delta x/\lambda$$

In a similar manner, MAC/ALU 56 is implemented to be responsive to input signals $\theta y$, dy, $\lambda$ and $\Delta y$ for computing the value of PHOY according to the equation:

$$PHOY = -(2\pi dy \sin \theta y)\Delta y/\lambda$$

It should be noted that the MAC/ALU circuits 53–56 can be readily implemented to perform their above-indicated operations by means of well-known logic circuits and engineering techniques. Hence the MAC-/ALU circuits 53–56 require no further description.

Look-up tables 59 and 60 respectively utilize the input signals, $\lambda$ and beam shape, as addresses to output the FREQ and AP# (aperture number) control signals. However, it should be understood that the look-up tables 59 and 60 could be replaced with many alternate implementations of the transform function. In fact, both of the look-up tables 59 and 60 could be replaced with a single ROM or RAM which is simultaneously addressed by the $\lambda$ and beam shape signals to initiate two separate simultaneous look-ups that produce the control signals FREQ and AP#.

Figure 7:
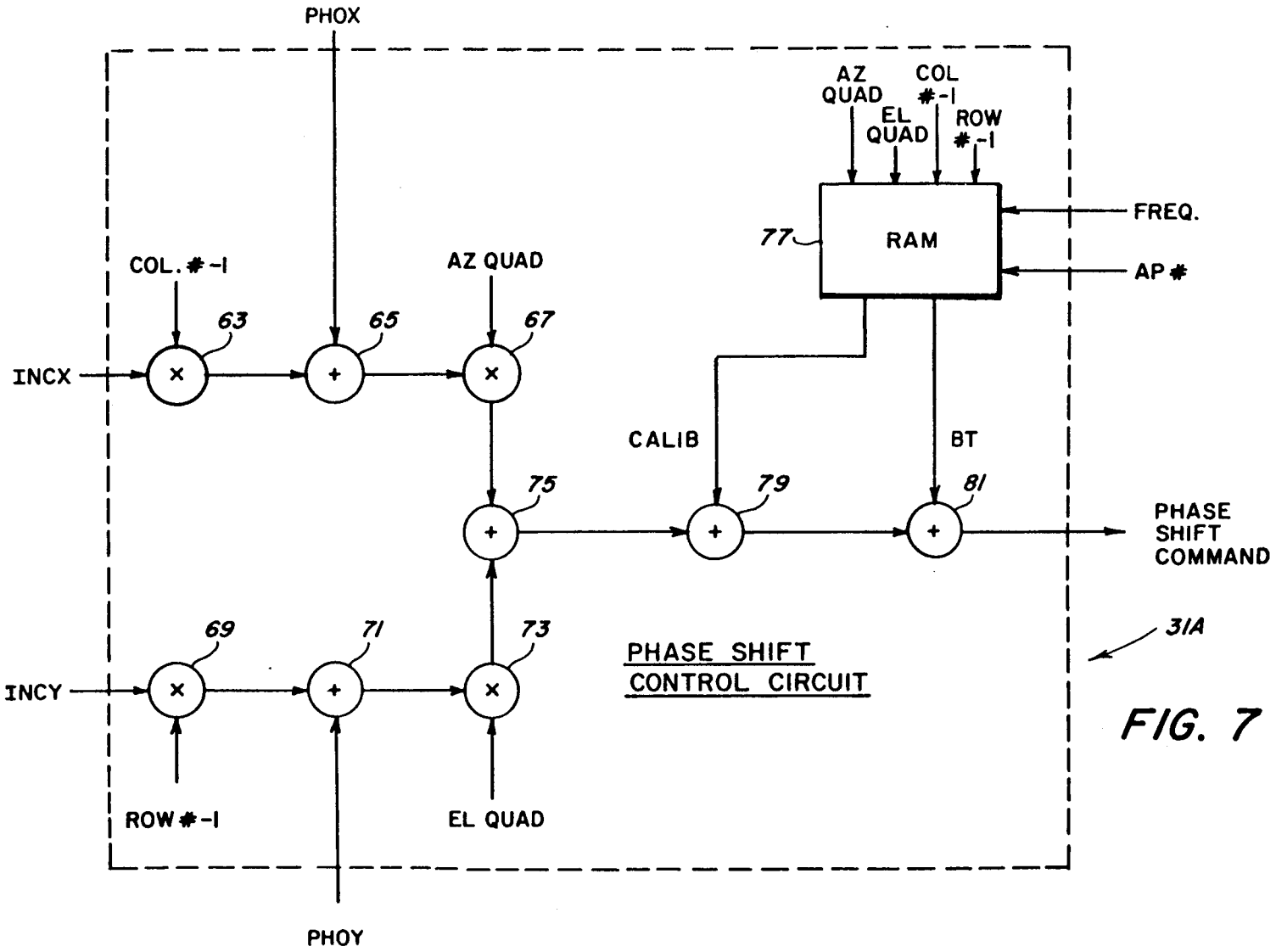
FIG. 7 is a schematic block diagram of a first type of phase shift control circuit of FIG. 3.
Figure 8:
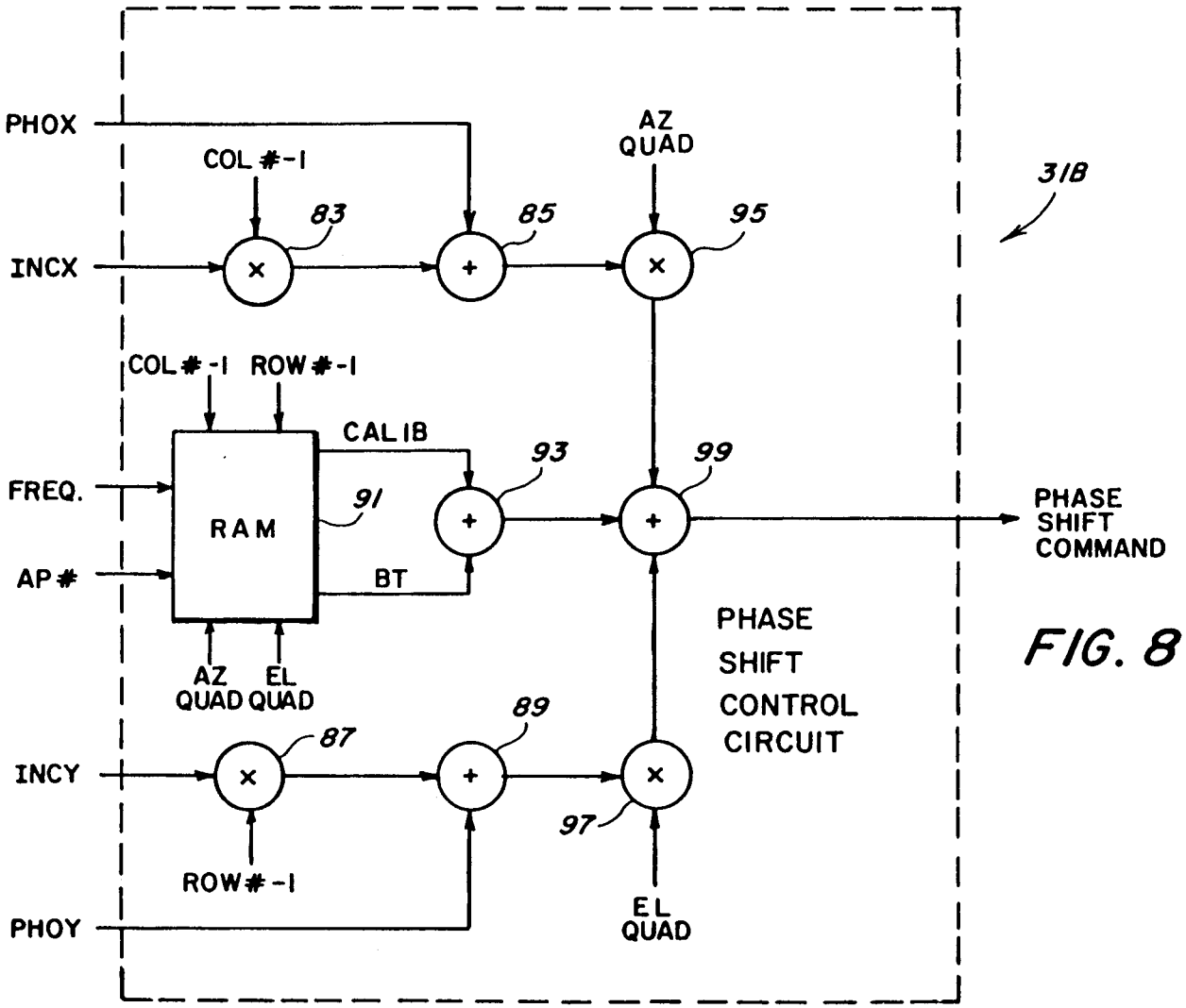
FIG. 8 is a schematic block diagram of a preferred type of phase shift control circuit of FIG. 3.

It should be recalled at this time that each phase shift control circuit 31 (FIG. 3) in the array 15 (FIG. 1) uses the six control signals (INCX, INCY, FREQ, PHOX, PHOY and AP#) from the controller 11 (FIG. 1), as well as the data that is internally-stored in that circuit 31, in a phase shift algorithm to determine the amount of phase shift that will be imparted to the input portion of RF power applied to its associated phase shifter 33 (FIG. 3). There are many different ways that this phase shift algorithm could be implemented in hardware in the phase shift control circuit 31 (FIG. 3). FIGS. 7 and 8 show two implementations of this phase shift algorithm. Obviously, other hardware implementations of this phase shift algorithm would involve a trade off of cost and complexity with the speed of the implementation.

Referring now to FIG. 7, a schematic block diagram of a first type 31A of phase shift control circuit 31 (FIG. 3) is shown. As mentioned before, a separate phase shift control circuit 31 is located in each of the assemblies 17 of the array 15 (FIG. 1). As a result, each phase shift control circuit 31 in the array 15 of FIG. 1 has a fixed physical location or position in the array 15 that is identified by its column, row and quadrant numbers or locations in the Cartesian coordinate system of the array 15, as shown in FIGS. 1 and 2. These column, row and quadrant locations are respectively represented by COL#, ROW# and azimuth (AZ) and elevation (EL) QUAD position data signals.

Since, as shown in FIGS. 1 and 2, column C1 is the center column of the array 15 and row R1 is the center row of the array 15, the COL# and ROW# position signals of any given assembly 17 in the array 15 have to be changed to COL#-1 and ROW#-1 to identify the specific location of an assembly 17 with respect to the center assembly 29 of FIG. 1. For example, as indicated in FIGS. 1 and 2, a phase shift control circuit 31 in an assembly 17 located in quadrant 1, column C4 and row R3 would specifically be in assembly 61 of FIG. 1. However, column C4 is only three columns away from column C1 of center assembly 29 and only two rows away from row R1 of center assembly 29. Therefore, the specific location of assembly 61 with respect to center assembly 29 is given by the position signals COL#-1 and ROW#-1, or COL 3 and ROW 2.

The AZ and EL QUAD, COL#-1 and ROW#-1 data signals for each phase shift control circuit 31A (FIG. 7) may be internally stored in that circuit 31A by means of, for example, suitable switches or an $E^2$ROM (not shown). Alternatively, these signals may be externally specified to circuit 31A by its position in the array 15.

In the phase shift control circuit 31A of FIG. 7, the signal INCX is multiplied in a multiplier 63 by the signal COL#-1 for control circuits 31 in column #C. The output product of multiplier 63 is added in combiner 65 to its associated azimuth phase offset PHOX to determine the absolute phase zero location in azimuth on the antenna 13 (FIGS. 1 and 2). The combined output of combiner 65 is multiplied in a circuit 67 by the AZ QUAD signal. The AZ QUAD signal is a +1 when the control circuit 31A is in an assembly 17 that is located on or to the right of column C1 of the array 15 of FIG. 1 (or in quadrant 1 or 4), and a −1 when the control circuit 31A is in an assembly 17 that is located to the left of column C1 in the array 15 of FIG. 1 (or in quadrant 2 or 3). Thus, the circuit 67 develops an absolute phase zero azimuth gradient signal. The circuit 67 could be a combiner which performs two's complement arithmetic on the output of the combiner 65 to develop the absolute phase zero azimuth gradient signal as a function of the sign of the AZ QUAD signal.

The signal INCY is multiplied in a multiplier 69 by the signal ROW#-1 for control circuits 31A in row #R. The output product of multiplier 69 is added in combiner 71 to its associated elevation phase offset PHOY to determine the absolute phase zero location in elevation of the circuit 31A on the antenna 13 (FIGS. 1 and 2). The combined output of combiner 71 is multiplied in a circuit 73 by the EL QUAD signal. The EL QUAD signal is a +1 when the control circuit 31A is in an assembly 17 that is located on or above row R1 of the array 15 of FIG. 1 (or in quadrant 1 or 2), and a −1 when the control circuit 31A is in an assembly 17 that is located below row R1 of the array 15 of FIG. 1 (or in quadrant 3 or 4). As a result, the circuit 73 develops an absolute phase zero elevation gradient signal. The circuit 73 is similar to the circuit 67 and could be a combiner which performs two's complement arithmetic on the output of the combiner 71 to develop the absolute phase zero elevation gradient signal as a function of the sign of the EL QUAD signal. It should be noted that "above", "below", "right", "left", etc. are arbitrary notations for consistently achieving proper phase combinations.

The azimuth and elevation gradient signals from circuits 67 and 73 are superimposed upon each other by summing them together in a combiner 75 to develop a combined signal.

A RAM (random access memory) 77 uses the FREQ and AP#control signals and the internally-stored AZ QUAD, EL QUAD, COL#-1 and ROW #-1 signals as a composite address to develop CALIB and BT output signals. The internally-stored signals and the FREQ signal are used by the RAM 77 to generate the CALIB signal, while the internally-stored signals and the AP# signal are used by the RAM 77 to generate the BT signal.

The control signal FREQ defines the current center operating frequency. For example, assume that a radar system can operate between 1000 MHz and 3000 MHz. That is its operating bandwidth. Further assume that at any given time it can be operated over a 200 MHz instantaneous bandwidth. So there would be ten different 200 MHz subbands within its 2000 MHz bandwidth -such as 1000–1200 MHz, 1200–1400 MHz, and 2800–3000 MHz. The center frequency of a subband would designate which subband was selected. For example, a center frequency of 1100 MHz would designate the first subband of 1000–1200 MHz, while a center frequency of 2900 MHz would designate the tenth subband of 2800–3000 MHz. The input wavelength signal λ would indicate the desired subband to the controller 11. Thus, a FREQ value of, for example, 1 from the controller 11 (FIG. 1) would represent the center frequency of 1100 MHz for subband one, while a FREQ value of, for example, 10 from the controller 11 would represent the center frequency of 2900 MHz for subband ten.

The control signal AP# defines the desired aperture shape of the beam. From a radar point of view, the aperture determines the shape of the beam wavefront in the far field. For example, assume that there are ten different aperture (AP) numbers - AP#1 through AP#10. In this case, AP#1 could define a planar wavefront beam having a focal point at infinity, AP#10 could define a beam having a focal point at a range of one mile, and the remaining AP numbers could define beams having focal points at ranges between infinity and one mile. Another use of AP# is to specify phase-only null positions in the beam pattern. For example, ten different null positions in azimuth could respectively be assigned to AP #1 through AP #10. Selection of the azimuth null position is then affected by selection of a specified AP#.

Each phase shifter 33 (FIG. 3) associated with the control circuit 31A has a unique calibration value or CALIB for a given frequency range or FREQ control signal, and a unique beam transform or BT selected by the AP# control signal. The calibration values for the various frequency ranges of a control circuit 31A are initially set as a function of the energy shape and the power distribution network 21 to substantially make each phase shifter in the array 15 have the same phase shift for any given frequency range. The calibration values are stored in RAM 77 and read and write memory (not shown) to accommodate array 15 calibration, as necessary.

The CALIB signal from RAM 77 is combined in a combiner 79 with the combined signal from combiner 75 to produce an intermediate signal. This intermediate signal from combiner 79 is then combined in a combiner 81 with the BT signal from RAM 77 to generate the phase shift command signal, which represents the total phase shift for the associated phase shifter 33 (FIG. 2). Thus, the summation of the azimuth and elevation phase gradient signals, calibration value and beam transform signal produces the phase shift command signal which determines the total phase shift that is to be imparted to the RF power applied to the phase shifter 33 (FIG. 3) associated with the control circuit 31A.

It therefore should be obvious that any arbitrary beam shape can be formed as a function of phase at each of the phase shifters 33 (FIG. 3) in the array 15 of FIG. 1 and impedance matched by the associated dipoles 35 (FIG. 3).

When the phase shift control circuit 31A of FIG. 7 is used in each assembly 17 (FIG. 1) in the operation of the system of FIG. 1, the INCX, INCY and FREQ control signals could be transmitted to each of the assemblies 17 of the array 15 during a first time period and then the PHOX, PHOY and AP# could be transmitted to the array 17 during a second time period. In this case, data storage and timing circuits (not shown) would be needed in the operation of each control circuit 31A. Such data storage and timing circuits are well-known conventional circuits which have been omitted from this description to facilitate the reader's understanding of the invention.

In a modification of the above embodiment, the composite bus 23 of FIG. 1 could contain six parallel buses which continuously respectively transmit the six control signals to each of the control circuits 31A (FIG. 7) in the array 15 (FIG. 1). When a different beam pointing direction and beam shape is desired for the formed beam, a different set of six control signals would be continuously transmitted to the control circuits 31A (FIG. 7) in the array 15. In this modification, no data storage and timing circuits would be needed in each control circuit 31A (FIG. 7) of the array 15.

The phase shift algorithm (shown in the hardware implementation of FIG. 7) has several opportunities for parallel computation. The offset AZ and EL phase gradients can be separately computed immediately upon the availability of INCX and PHOX for the offset AZ phase gradient and INCY and PHOY for the offset EL phase gradient. The calibration value (CALIB) and beam transform value (BT) can each be selected when the control signals FREQ and AP# are available. These CALIB and BT values can be selected independently of each of the offset AZ and EL phase gradient computations. Thus, three independent computations can be performed simultaneously before the phase shift algorithm performs a final addition.

Referring now to FIG. 8 a schematic block diagram of a preferred type 31B of the phase shift control circuit 31 (FIG. 3) is shown for use in each of the assemblies 17 of FIG. 1. The implementation of FIG. 8 provides the most parallel form of the phase shift algorithm and, hence, a highly time-efficient realization of that phase shift algorithm. Thus, when the phase shift control circuit 31B of FIG. 8 is used in each assembly 17 of the array 15 (FIG. 1), each control circuit 31B simultaneously receives the six control signals of INCX, PHOX, INCY, PHOY, FREQ and AP# from the controller 11 (FIG. 1) by way of the composite bus 23, junction 25 and network 27 of FIG. 1. In this case the composite bus 23 would be comprised of six parallel buses (not shown).

The COL#-1, ROW#-1, AZ QUAD and EL QUAD signals for each phase shift control circuit 31B (FIG. 8) are unique to that circuit 31B and may be internally stored in that circuit 31B by means of, for example, suitable switches or an $E^2$ROM (not shown). Inside each phase shift control circuit 31B, three separate arms of the phase shift algorithm run in parallel on pipelined combinatorial logic for the parallel processing of various control and internally-stored signals.

In a first arm, INCX is multiplied in a multiplier 83 by the signal COL#-1 to establish the location of the AZ phase gradient. The output product of multiplier 83 is combined in a combiner 85 with its associated azimuth phase offset PHOX to determine the absolute phase zero location in azimuth of the circuit 31B on the antenna 13 (FIGS. 1 and 2).

In a second arm, INCY is multiplied in a multiplier 87 by the signal ROW #-1 to establish the location of the EL phase gradient. The output product of multiplier 87 is combined in a combiner 89 with its associated elevation phase offset PHOY to determine the absolute phase zero location in elevation of the circuit 31B on the antenna 13 (FIGS. 1 and 2).

In a third arm, a RAM 91 uses the FREQ and AP# control signals and the internally-stored AZ QUAD, EL QUAD, COL#-1 and ROW#-1 signals as a composite address to develop CALIB and BT output signals. The internally-stored signals and the FREQ signal are used by the RAM 91 to generate the CALIB signal, while the internally-stored signals and the AP# signal are used by the RAM 91 to generate the BT signal. The CALIB and BT signals are combined in a combiner 93 to develop a combined signal.

Thus the combiners 85, 89 and 93 simultaneously develop outputs due to the parallel processing in the above-identified three arms.

The output of combiner 85 is multiplied in a circuit 95 by the previously-defined AZ QUAD signal to develop an absolute phase zero azimuth gradient signal. This multiplication is made to affect a sign change if the phase shift control circuit 31B is located in quadrant 2 or 3 (FIGS. 1 and 2). The multiplication to affect a sign change is incorporated as a subtraction in two's complement arithmetic and hence the sign change multiply time in circuit 95 is not included in the processing time.

The output of combiner 89 is multiplied in a circuit 97 by the previously-defined EL QUAD signal to develop an absolute phase zero elevation gradient signal. This multiplication is made to affect a sign change if the phase control circuit 31B is located in quadrant 3 or 4 (FIGS. 1 and 2). As with the circuit 95, the multiplication to affect a sign change is incorporated as a subtraction in two's complement arithmetic and hence the sign change multiply time in circuit 97 is not included in the processing time.

The outputs of the combiner 93 and circuits 95 and 97 are then combined in a combiner 99 to produce the phase shift command signal which determines the total phase shift that is to be imparted to the RF power applied to the phase shifter 33 (FIG. 3) associated with the phase shift control circuit 31B.

The total time for the circuit 31B to compute a new beam transform is the longest path through the implemented phase shift algorithm of FIG. 8. This is the flow through time to perform one multiplication (in 83 or 87) and three additions (in 85, 95, 99 or in 89, 97, 99). If control of the phase zero location is not desired, the parameters or control signals PHOX and PHOY are not needed. If PHOX and PHOY are not needed, the flow through time is the time needed to perform one multiplication (in 83 or 87) and two additions (in 95, 99 or 97, 99).

The following TABLE 1 illustrates an exemplary phase state formed by the application of the phase shift algorithm of FIG. 7 or 8 to a specific set of inputs using a real antenna 13. More specifically, TABLE 1 shows the computed phase shift command values at each phase shifter 33/dipole 35 in the planar array 15 of 11 rows by 27 columns of phase shifters 33/dipoles 35, assuming that: all calibration values (CALIB) are 135 degrees; the specified beam transform (BT) is the physical aperture (BT[]=0); PHOX and PHOY are each 0.0 degrees; and INCX and INCY are each 5.625 degrees.

TABLE I

| ELECTRICAL COLUMN ADDRESS | ELECTRICAL ROW ADDRESS | | | | | | | | | | |
|---|---|---|---|---|---|---|---|---|---|---|---|
| | 6 | 5 | 4 | 3 | 2 | 1 | 2 | 3 | 4 | 5 | 6 |
| 14 | 033.75 | 039.38 | 045.00 | 050.63 | 056.25 | 061.88 | 067.50 | 073.13 | 078.75 | 084.38 | 090.00 |
| 13 | 039.38 | 045.00 | 050.63 | 056.25 | 061.88 | 067.50 | 073.13 | 078.75 | 084.38 | 090.00 | 095.63 |
| 12 | 045.00 | 050.63 | 056.25 | 061.88 | 067.50 | 073.13 | 078.75 | 084.38 | 090.00 | 095.63 | 101.25 |
| 11 | 050.63 | 056.25 | 061.88 | 067.50 | 073.13 | 078.75 | 084.38 | 090.00 | 095.63 | 101.25 | 106.88 |
| 10 | 056.25 | 061.88 | 067.50 | 073.13 | 078.75 | 084.38 | 090.00 | 095.63 | 101.25 | 106.88 | 112.50 |
| 9 | 061.88 | 067.50 | 073.13 | 078.75 | 084.38 | 090.00 | 095.63 | 101.25 | 106.88 | 112.50 | 118.13 |
| 8 | 067.50 | 073.13 | 078.75 | 084.38 | 090.00 | 095.63 | 101.25 | 106.88 | 112.50 | 118.13 | 123.75 |
| 7 | 073.13 | 078.75 | 084.38 | 090.00 | 095.63 | 101.25 | 106.88 | 112.50 | 118.13 | 123.75 | 129.38 |
| 6 | 078.75 | 084.38 | 090.00 | 095.63 | 101.25 | 106.88 | 112.50 | 118.13 | 123.75 | 129.38 | 135.00 |
| 5 | 084.38 | 090.00 | 095.63 | 101.25 | 106.88 | 112.50 | 118.13 | 123.75 | 129.38 | 135.00 | 140.63 |
| 4 | 090.00 | 095.63 | 101.25 | 106.88 | 112.50 | 118.13 | 123.75 | 129.38 | 135.00 | 140.63 | 146.25 |
| 3 | 095.63 | 101.25 | 106.88 | 112.50 | 118.13 | 123.75 | 129.38 | 135.00 | 140.63 | 146.25 | 151.88 |
| 2 | 101.25 | 106.88 | 112.50 | 118.13 | 123.75 | 129.38 | 135.00 | 140.63 | 146.25 | 151.88 | 157.50 |
| 1 | 106.88 | 112.50 | 118.13 | 123.75 | 129.38 | 135.00 | 140.63 | 146.25 | 151.88 | 157.50 | 163.13 |
| 2 | 112.50 | 118.13 | 123.75 | 129.38 | 135.00 | 140.63 | 146.25 | 151.88 | 157.50 | 163.13 | 168.75 |
| 3 | 118.13 | 123.75 | 129.38 | 135.00 | 140.63 | 146.25 | 151.88 | 157.50 | 163.13 | 168.75 | 174.38 |
| 4 | 123.75 | 129.38 | 135.00 | 140.63 | 146.25 | 151.88 | 157.50 | 163.13 | 168.75 | 174.38 | 180.00 |
| 5 | 129.38 | 135.00 | 140.63 | 146.25 | 151.88 | 157.50 | 163.13 | 168.75 | 174.38 | 180.00 | 185.63 |
| 6 | 135.00 | 140.63 | 146.25 | 151.88 | 157.50 | 163.13 | 168.75 | 174.38 | 180.00 | 185.63 | 191.25 |
| 7 | 140.63 | 146.25 | 151.88 | 157.50 | 163.13 | 168.75 | 174.38 | 180.00 | 185.63 | 191.25 | 196.88 |
| 8 | 146.25 | 151.88 | 157.50 | 163.13 | 168.75 | 174.38 | 180.00 | 185.63 | 191.25 | 196.88 | 202.50 |
| 9 | 151.88 | 157.50 | 163.13 | 168.75 | 174.38 | 180.00 | 185.63 | 191.25 | 196.88 | 202.50 | 208.13 |
| 10 | 157.50 | 163.13 | 168.75 | 174.38 | 180.00 | 185.63 | 191.25 | 196.88 | 202.50 | 208.13 | 213.75 |
| 11 | 163.13 | 168.75 | 174.38 | 180.00 | 185.63 | 191.25 | 196.88 | 202.50 | 208.13 | 213.75 | 219.38 |
| 12 | 168.75 | 174.38 | 180.00 | 185.63 | 191.25 | 196.88 | 202.50 | 208.13 | 213.75 | 219.38 | 225.00 |
| 13 | 174.38 | 180.00 | 185.63 | 191.25 | 196.88 | 202.50 | 208.13 | 213.75 | 219.38 | 225.00 | 230.63 |

TABLE I-continued

| ELECTRICAL COLUMN ADDRESS | ELECTRICAL ROW ADDRESS | | | | | | | | | | |
|---|---|---|---|---|---|---|---|---|---|---|---|
| | 6 | 5 | 4 | 3 | 2 | 1 | 2 | 3 | 4 | 5 | 6 |
| 14 | 180.00 | 185.63 | 191.25 | 196.88 | 202.50 | 208.13 | 213.75 | 219.38 | 225.00 | 230.63 | 236.25 |

Note that any desired set of input signals ($\theta x$, $\theta y$, dx, dy, $\lambda$, $\Delta x$, $\Delta y$ and beam shape) could be applied to the controller 11. The four control signals INCX, INCY, PHOX and PHOY could then be computed as indicated by the equations in the MAC/ALU's 53–56 shown in FIG. 6, and the remaining two control signals FREQ and AP# could be derived from the look-up tables 59 and 60. The look-up tables 59 and 60 could be programmed to store desired frequency and aperture ranges as respective functions of different wavelengths and beam shapes. Finally, the phase shift command values for each of phase shifters 33/dipoles 35 in the array 17 of FIG. 1 could be derived by substituting the derived values of the control signals and internally-stored position data into the phase shift algorithm, as indicated in the implemented phase shift control circuit shown in either FIG. 7 or FIG. 8.

Figure 9:
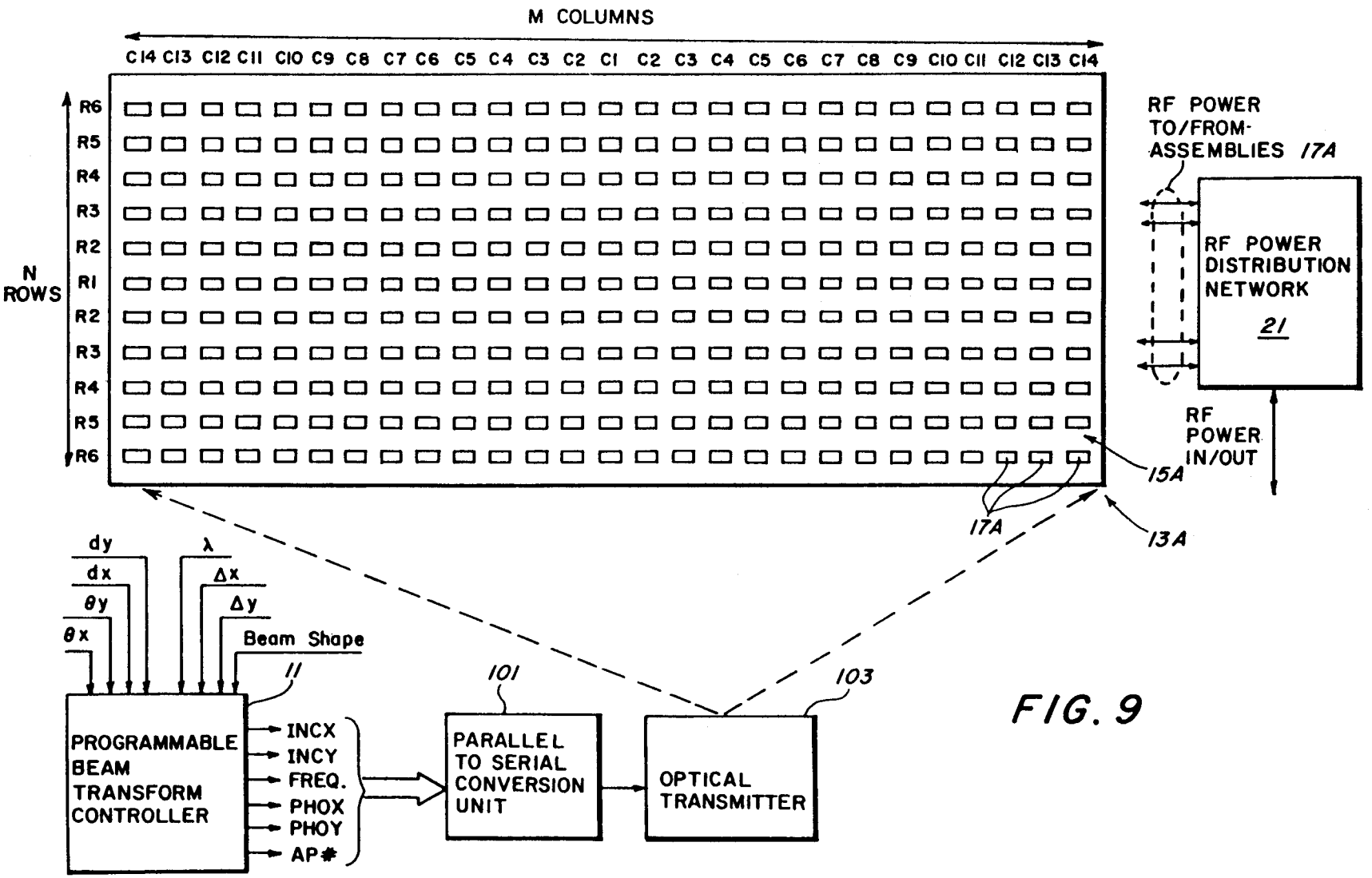
FIG. 9 is a schematic block diagram of a second embodiment of the invention.

Referring now to FIG. 9, a schematic block diagram of a second embodiment of the invention is shown. The embodiment of FIG. 9 illustrates a cableless version of the embodiment of FIG. 1. The programmable beam transform controller 11A and RF power distribution network 21A of FIG. 9 are similar in structure and operation to the controller 11 and RF power distribution network 21 of FIG. 1 and, hence, need no further description. However, it should be noted that the controller 11A is located at a preselected distance from the array 15A in line sight of optical receivers 105 (FIG. 10) of the phase shift assemblies 17A.

The INCX, INCY, FREQ, PHOX, PHOY and AP# control signals are sequentially fed to a parallel-to-serial conversion unit 101 which converts each control signal word from a parallel format to a serial format. Each serial digital bit from the unit 101 is then transmitted by an optical transmitter 103, such as a laser or superluminescent diode, to a phased array antenna 13A which includes a planar array or matrix 15A of M columns and N rows of receiver/phase shift assemblies 17A. Each of the assemblies 17A simultaneously receives the serial optical data transmitted from the optical transmitter 103. As discussed before, the power distribution network 21 distributes portions of input RF power or energy to the assemblies 17A in the array 15A.

One of the assemblies 17A in the array 15A will be discussed by now referring to FIGS. 10 and 3. The serial optical data from transmitter 103 is converted from serial optical data to serial electrical data or words by an optical receiver 105, such as a photodetector. The serial electrical data from the optical receiver 105 is converted from a serial format to a parallel format by a serial-to-parallel conversion unit 107. The parallel-formatted output of the unit 107 is then stored in a memory 109, which develops and applies the INCX, INCY, FREQ, PHOX, PHOY and AP# control signals to the phase shift assembly 17 of FIG. 3. Alternatively, the serial-to-parallel conversion unit 107 may decode a very long bit stream through a series of internal cascaded shift registers (not shown). In this case the memory 109 could be deleted and the control signals would simply be read from the bit stream in sequence. The utilization of these control signals by the phase shift control circuit 31 to develop a phase shift command signal to control the amount of the phase shift of RF energy applied to the phase shifter 33/dipole 35 is the same as previously discussed and needs no further description.

Figure 10:
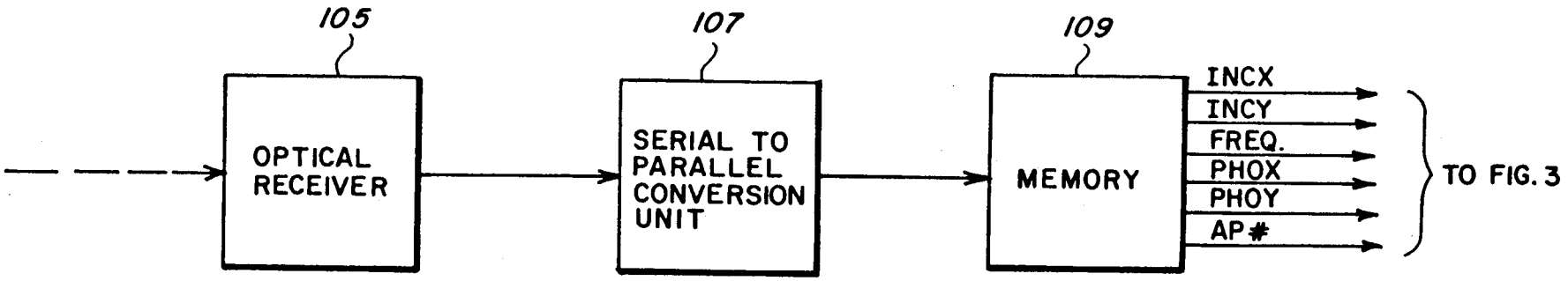
FIG. 10 is a schematic block diagram of additional structure that is added to the front end of the phase shift assembly of FIG. 3 in the second embodiment of the invention of FIG. 9.

For a faster, but more complex, throughput of control signal data in the system of FIGS. 9 and 10, three different conversion units 103 and three different optical transmitters 103 could be used to simultaneously transmit three control words or signals at three different frequencies to each of the assemblies 17A during each of two time periods. To process such data in the array 15A, each receiver portion in FIG. 10 would utilize three different optical receivers 105 at receiver frequencies corresponding to the three transmitted frequencies, and three serial-to-parallel conversion units 107. For an optimum throughput, six of each of the above-identified elements would be used instead of three.

Thus, the means for communicating the parameters or control signals of the phase shift algorithm to each assembly 17 (or 17A) in the array 15 of FIG. 1 (or array 15A of FIGS. 9 and 10) need not be by three parallel electrical or optical buses, six parallel electrical or optical buses, or even by one electrical or optical bus. Any communication scheme that satisfies the demand for the parameters or control signals by the phase shift algorithm would be sufficient.

Therefore, what has been described is a control system for a phased array antenna that electronically performs both beam steering and beam shaping operations. The ability to steer a wavefront, arbitrarily locate the absolute phase zero center on the aperture surface, while simultaneously correcting for fixed errors and forming any arbitrary phase function upon any beam position is a new capability for phased array radars.

It should therefore readily be understood that many modifications and variations of the present invention are possible within the purview of the claimed invention. It is therefore to be understood that, within the scope of the appended claims, the invention may be practiced otherwise than as specifically described.

We claim:

1. A programmable beam transform system for a phased array antenna, said system comprising:

an array of assemblies contained in said antenna, each said assembly containing its own associated internally-stored data; and a programmable beam transform controller responsive to a plurality of programmable input signals for selectively generating and applying a plurality of control signals to each of said assemblies to enable said assemblies to collectively perform both beam steering and beam-shaping operations;

each of said assemblies modifying said plurality of control signals applied thereto as a function of its associated internally-stored data to phase shift associated energy applied thereto in order to cause said assemblies to collectively transmit and/or receive an energy beam at any desired beam position and with any desired beam pattern.

2. The system of claim 1 wherein each said assembly includes:

a phase shift control circuit for modifying said plurality of control signals applied thereto as a function of its associated internally-stored data to produce an associated phase shift command signal;

a phase shifter for phase shifting associated energy applied thereto as a function of said associated phase shift command signal; and means for transmitting and/or receiving said phase shifted associated energy.

3. The system of claim 2 wherein said programmable beam transform controller includes:

circuit means selectively responsive to associated ones of said plurality of input signals for selectively generating and applying said plurality of control signals to each of said phase shift control circuits.

4. The system of claim 3 further including:

a power distribution network for selectively distributing associated portions of energy to said phase shifters in said assemblies.

5. A programmable beam transform system for an electronically steered phase array antenna, said system comprising:

control means for selectively developing a plurality of control signals as a function of a plurality of programmable input signals; and antenna means contained in said antenna for controlling as a function of said plurality of control signals the position and pattern of an energy beam transmitted and/or received from said antenna, said antenna means including an array of assemblies with each said assembly receiving said plurality of control signals, each said assembly containing its own associated internally-stored data for modifying said plurality of control signals as a function of its associated internally-stored data to accordingly phase shift an associated portion of energy applied thereto as a function of said modified plurality of control signals.

6. The system of claim 5 wherein each said assembly includes:

a phase shift control circuit for modifying said plurality of control signals applied thereto as a function of its associated internally-stored data to produce an associated phase shift command signal;

phase shifter for phase shifting associated energy applied thereto as a function of said associated phase shift command signal; and means for transmitting and/or receiving said phase-shifted associated energy.

7. The system of claim 6 wherein said control means includes:

a programmable beam transform controller responsive to said plurality of programmable input signals for selectively generating and applying said plurality of control signals to each of said phase shift control circuits in said array.

8. The system of claim 7 further including:

a power distribution network for selectively distributing portions of input energy to said phase shifters in said array.

9. The system of claim 7 wherein: said plurality of programmable input signals include $\theta x$, $\theta y$, dx, dy, $\Delta x$, $\Delta y$, $\lambda$ and beam shape signals; said plurality of control signals include first, second, third, fourth, fifth and sixth signals; and said programmable beam transform controller includes:

a first circuit for developing said first signal as a function of the equation: first signal $= (2\pi dx \sin \theta x)/\lambda$;

a second circuit for developing said second signal as a function of the equation: second signal $= (2\pi dy \sin \theta y)/\lambda$;

a third circuit for developing said third signal as a function of the equation: third signal $= -(2\pi dx \sin \theta x)\Delta x/\lambda$;

a fourth circuit for developing said fourth signal as a function of the equation: fourth signal $= -(2\pi dy \sin \theta y)\Delta y/\lambda$;

a fifth circuit responsive to said $\lambda$ signal for developing said fifth signal; and a sixth circuit responsive to said beam signal for developing said sixth signal; where:

said $\theta x$ and $\theta y$ signals respectively represent the angles of the desired energy beam wavefront measured with respect to the normal of said array in azimuth and elevation, respectively;

said dx and dy signals respectively represent the distances between adjacent ones of said phase shifters in azimuth and elevation, respectively;

said $\Delta x$ and $\Delta y$ signals respectively represent the distances that the phase center of the desired energy beam wavefront is to be displaced from the physical center of said array in azimuth and elevation, respectively;

said $\lambda$ signal represents the wavelength of the energy to be transmitted and/or received; and said beam shape signal represents a desired aperture of the desired energy beam pattern

10. The system of claim 7 wherein said plurality of programmable input signals include signals representative of a desired pointing direction of said energy beam, the dimensions of said antenna, the operating wavelength of the energy beam, and a desired beam pattern; and wherein said programmable beam transform controller is selectively responsive to said plurality of programmable input signals for selectively generating said plurality of control signals which include:

a first signal representative of a desired azimuth phase gradient;

a second signal representative of a desired elevation phase gradient;

a third signal representative of a desired phase offset for the azimuth phase gradient;

a fourth signal representative of a desired phase offset for the elevation phase gradient;

a fifth signal representative of a desired frequency range of said energy; and a sixth signal representative of a desired aperture for the beam pattern.

11. The system of claim 10 wherein each said phase shift control circuit includes:

first and second multiplier means respectively responsive to said first and second signals and to respective location signals for respectively developing first and second product signals;

a first combiner for combining said first product signal and said third signal to produce a first combined signal;

a second combiner for combining said second product signal and said fourth signal to produce a second combined signal;

means responsive to said first combined signal and to an azimuth quadrant signal indicative of the relative azimuth position of the associated phase shifter in said array for producing a signed first command signal;

means responsive to said second combined signal and to an elevation quadrant signal indicative of the relative elevation position of said associated phase shifter in said array for producing a signed second combined signal;

memory means responsive to said fifth and sixth signals for developing seventh and eighth signals; and means for combining said signed first and second combined signals and said seventh and eighth signals to produce an associated phase shift command signal.

12. The system of claim 11 wherein said combining means includes:

a third combiner for combining said signed first and second combined signals to produce a total combined signal;

a fourth combiner for combining said total combined signal and said seventh signal to produce an intermediate signal; and a fifth combiner for combining said intermediate signal and said eighth signal to produce said phase shift command signal.

13. The system of claim 11 wherein said combining means includes:

a third combiner for combining said seventh and eighth signals to produce a third combined signal; and a fourth combiner for combining said signed first and second combined signals and said third combined signal to produce said phase shift command signal.

14. A programmable beam transform system for an electronically steered phase array antenna, said system comprising:

control means for selectively developing a plurality of control signals as a function of a plurality of programmable input signals; and antenna means contained in said antenna for controlling as a function of said plurality of control signals the position and pattern of an energy beam transmitted and/or received from said antenna;

said control means including:

a programmable beam transform controller for selectively generating a plurality of parallel-formatted digital control signals as a function of a plurality of programmable input signals;

means for converting the parallel-formatted digital control signals to serial control signals; and an optical transmitter for transmitting said serial control signals to said antenna means; and said antenna means including:

an optical receiver for receiving said serial control signals from said optical transmitter;

means for converting said serial control signals to a plurality of parallel-formatted digital control signals; and an array of assemblies with each said assembly receiving said plurality of control signals, each said assembly containing its own associated internally-stored data for modifying said plurality of control signals as a function of its associated internally-stored data to accordingly phase shift an associated portion of energy applied thereto as a function of said modified plurality of control signals.

15. The system of claim 14 wherein each said assembly includes:

a phase shift control circuit for modifying said plurality of control signals applied thereto as a function of its associated internally-stored data to produce an associated phase shift command signal;

a phase shifter for phase shifting associated energy applied thereto as a function of said associated phase shift command signal; and means for transmitting and/or receiving said phase-shifted associated energy.

16. The system of claim 15 wherein said plurality of programmable input signals include signals representative of a desired pointing direction of said energy beam, the dimensions of said antenna, the operating wavelength of the energy beam, and a desired beam pattern to be radiated; and wherein said programmable beam transform controller is selectively responsive to said plurality of programmable input signals for selectively generating said plurality of control signals which include:

a first signal representative of a desired azimuth phase gradient;

a second signal representative of a desired elevation phase gradient;

a third signal representative of a desired phase offset for the azimuth phase gradient;

a fourth signal representative of a desired phase offset for the elevation phase gradient;

a fifth signal representative of a desired frequency range of said energy; and a sixth signal representative of a desired beam pattern.

17. The system of claim 16 wherein each said phase shift control circuit includes:

first and second multiplier means respectively responsive to said first and second signals and to respective location signals for respectively developing first and second product signals;

a first combiner for combining said first product signal and said third signal to produce a first combined signal;

a second combiner for combining said second product signal and said fourth signal to produce a second combined signal;

means responsive to said first combined signal and to an azimuth quadrant signal indicative of the relative azimuth position of the associated phase shifter in said array for producing a signed first combined signal;

means responsive to said second combined signal and to an elevation quadrant signal indicative of the relative elevation position of said associated phase shifter in said array for producing a signed second combined signal;

memory means responsive to said fifth and sixth signals for developing seventh and eighth signals; and means for combining said signed first and second combined signals and said seventh and eighth signals to produce an associated phase shift command signal.

18. The system of claim 17 further including:

a power distribution network for selectively distributing associated portions frequency energy to said phase shifters in said assemblies.

* * * * *